US006220176B1

(12) United States Patent
Gersemsky

(10) Patent No.: US 6,220,176 B1
(45) Date of Patent: Apr. 24, 2001

(54) TRAVELLING MECHANISM, ESPECIALLY FOR LIFTING DEVICES

(75) Inventor: Udo Gersemsky, Herdecke (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/286,572

(22) Filed: Apr. 5, 1999

(30) Foreign Application Priority Data

Apr. 8, 1998 (DE) ..... 198 16 576

(51) Int. Cl.[7] ..... B61B 11/00
(52) U.S. Cl. ..... 105/148; 105/141
(58) Field of Search ..... 104/89, 93, 111, 104/121; 105/141, 147, 148

(56) References Cited

U.S. PATENT DOCUMENTS

| | | | | |
|---|---|---|---|---|
| 2,470,060 | | 5/1949 | Webb et al. . | |
| 5,277,126 | * | 1/1994 | Wendt et al. | 105/155 |
| 5,809,896 | * | 9/1998 | Gersemsky | 104/93 |
| 6,058,849 | * | 5/2000 | Ostholt et al. | 104/93 |

FOREIGN PATENT DOCUMENTS 0 078085 A1 5/1983 (EP) .

* cited by examiner

*Primary Examiner*—Jesus D. Sotelo
*Assistant Examiner*—Robert J. McCarry, Jr.
(74) *Attorney, Agent, or Firm*—Cohen, Pontani, Lieberman & Pavane

(57) ABSTRACT

A travelling mechanism for travelling rail having flange parts and web parts. The mechanism including rest running wheels located opposite to each other which can rest on the flange parts. The flange sides of the rail guide rollers are arranged parallel to web rest in front of and behind each running wheel on both sides. The guide rollers, like the running wheels, are rotatably mounted in lateral bars connected below the travelling rail. The lateral bars are spaced from each other and connected to each other by a connecting traverse. To create a travelling mechanism that is adjustable, whereby the running wheels always run relatively close to the web, the travelling mechanism be adjustable to different flange widths by the use of connecting traverses of different lengths. The spacing between the axes of the guide rollers is variable independently of the running.

14 Claims, 2 Drawing Sheets

TRAVELLING MECHANISM, ESPECIALLY FOR LIFTING DEVICES

BACKGROUND OF THE INVENTION

1. Field of the Invention

The invention relates to a travelling mechanism, especially for a lifting device such as a hoist.

2. Discussion of the Prior Art

U.S. Pat. No. 2,470,060 discloses a travelling mechanism that can be used, in particular, for lifting devices. This travelling mechanism comprises a rail that consists of flange parts and web parts. Two running wheels, which are located opposite to each other, roll on the flange inner sides of the rail. To guide the travelling mechanism, guide rollers rest in front of and behind each running wheel, on both sides, parallel to the web. The running wheels and the guide rollers are rotatably-mounted in lateral bars. The two bars are spaced relative to each other and connected to each other by means of a connecting element in the manner of a traverse. However, this travelling mechanism can be used only for a predetermined flange width. It is assembled completely prior to use and then placed on the travelling rail. A change in the distance between the two lateral bars and thus between the running wheels is not possible. This travelling mechanism thus can be used only in rail profile systems with a constant flange width, whereby an optimal distance is selected between the web and the running wheels to attain the desired statically advantageous stress on the travelling rail and the travelling mechanism.

From European reference EP 0 078 085 A1, another travelling mechanism is known, which comprises a travelling rail and running wheels. The wheels are located opposite to each other and rest on the flange parts of the travelling rail. Guide rollers are not provided in this travelling mechanism. To adjust to different web widths, the bilaterally arranged bars, in which the running wheels are rotatably-mounted, are adjustable with respect to their spacing. Seen in the direction of travel, connecting traverses equipped with slots are located in front of and behind the travelling rail. The slots run in pairs on both sides of the web at a right angle to the direction of travel. The connecting traverse is attached to the bars with screws, which are inserted through the slots. This makes it possible to adjust the distance between the two bars.

Due to the intrinsic weight of the trolley, the clearance between the wheel flange and the flange side can be adjusted only by great force. However, the crucial disadvantage of this travelling mechanism is that, although adjustment to different flange widths is possible, the running wheels are, in the case of wider flanges, farther from the web. This leads to known disadvantages: The travelling rail is unfavorably stressed, and the flange is subjected to higher bending stress, which results in a larger profile having to be used.

SUMMARY OF THE INVENTION

Accordingly, it is an object of the present invention to provide a travelling mechanism that can be adjusted to different flange widths, whereby the running wheels always run relatively close to the web.

According to the invention, the travelling mechanism is adjustable to different flange widths by the use of connecting traverses of different lengths. Moreover, the distance between the axles is variable independently of the running wheels for the purpose of adjusting the guide rollers to the flange width. Advantageously, this allows the travelling mechanism to be easily adjusted to different flange widths. Moreover, the flange width can be adjusted even after the travelling mechanism has been mounted on the travelling rail. After adjustment of the guide roller spacing, it is possible, e.g., by test driving, to check whether the distance is sufficient and, if necessary, to undertake fine-tuning without great expense. In addition, in this travelling mechanism, the distance between the web and the running wheels remains constant regardless of the flange width, which leads to statically favorable stress on the travelling rail.

In a further embodiment, a slot extending at a right angle to the direction of travel and arranged on a horizontal plane is provided above each guide roller, through which slot the vertical rotational axis of the associated guide roller is run. The slot makes it possible to change the position of the guide roller relative to the web simply by moving the rotational axis inside the slot.

Adjusting the guide roller spacing is very simple when each rotational axis position can be fixed within two end positions defined by the length of the slot.

To avoid rotation of the fixed rotational axis and thus prevent loosening of the fixed position, each rotational axis is embodied as a bolt flattened on both sides, the larger diameter of which is larger than the slot width.

Simple prepositioning of the rotational axis is attained when, for each slot, a measurement strip is arranged between the end positions to determine the particular rotational axis position.

The stability of the web can be increased by equipping the lateral surfaces of the connecting traverse with a slot arranged at a right angle to the longitudinal direction of the connecting traverse, into which slot a complementary projection arranged on and belonging to the bar end engages in a positive-locking manner when the travelling mechanism is mounted. The slot connection prevents the bars from rotating relative to each other.

Advantageously, the slot is oriented in the direction of travel. In this way, rotational forces can be absorbed especially effectively.

When the bars are embodied asymmetrically, the assembly of the travelling mechanism can be further simplified by embodying the connecting traverse and one of the two bars in a single piece.

A very economical embodiment is obtained when the bar ends are attached to the connecting traverse at both ends by means of screws and clamping sleeves.

When the lateral surfaces of the web traverses are arranged in the area vertically below the support of the running wheels, the result, due to the low bending moment, is reduced tensile stress on the screw connections.

A load suspension means can be supported on the web traverse in a simple manner.

A travelling mechanism that runs very evenly and stably is attained when the load suspension means is supported in articulated fashion in a ball socket embodied on the upper side of the connecting traverse.

To prevent the travelling mechanism from pitching in the travelling direction, the lower end of the C-shaped load suspension means is equipped with a rotary-mounted sliding piece, which engages in a guide slot arranged on the lower side of the connecting traverse and oriented at a right angle to the direction of travel. The guide slot frees the pendulum motion of the load only at a right angle to the direction of travel.

A stable and compact travelling mechanism is attained when the bars, above the support points of the running wheels on the flange parts, are embodied to project toward the web.

The range of possible flange widths can be enlarged when the two bars form a C that is open at the top and has, on its inner sides at the level at which the guide rollers contact the flange parts, a vertical surface parallel to the running direction. Advantageously, the distance between the two vertical surfaces is equal to the greatest flange width of the lower flange.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
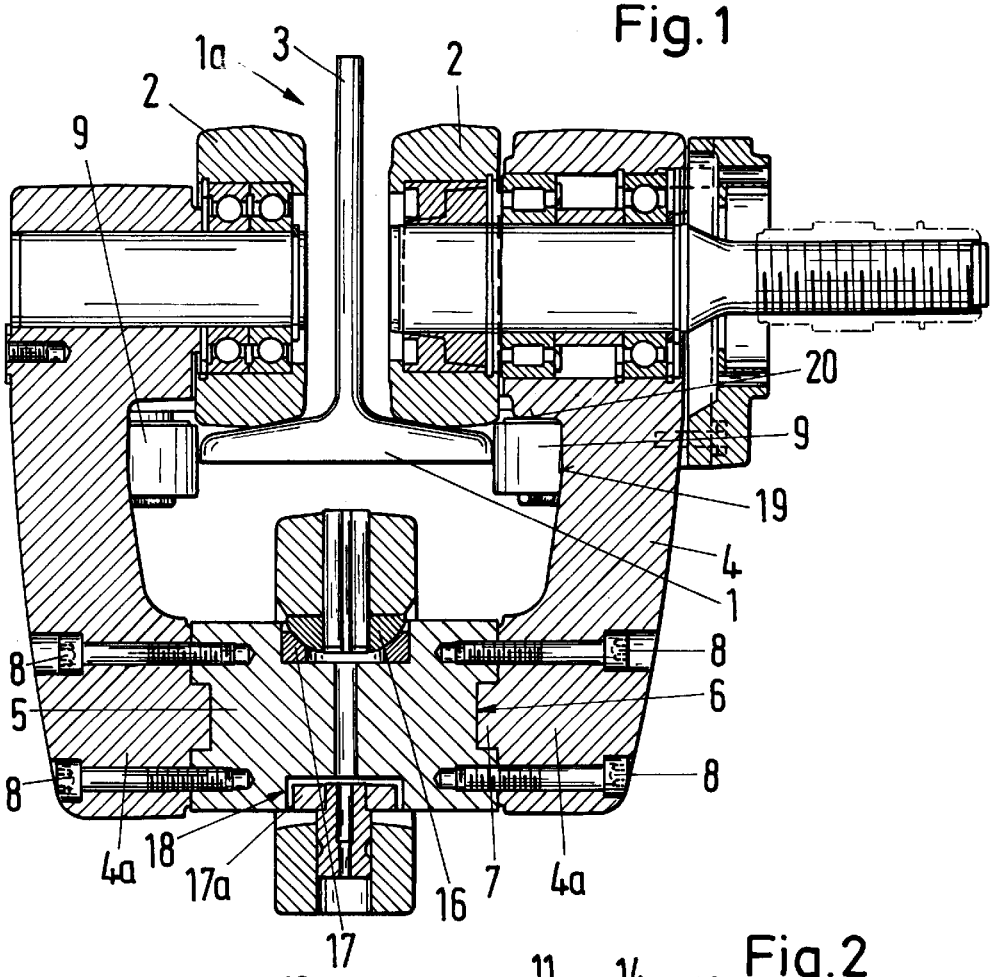
FIG. 1 is a cross-section through a travelling mechanism pursuant to the present invention.

FIG. 1 shows a cross-section through a travelling mechanism that rides on a lower flange 1 of a travelling rail 1*a*. Two running wheels 2, which are located opposite to each other, rest on the inner lateral surfaces of the lower flange 1. The running wheels 2 are rotatably-mounted in bars 4, which are arranged on both sides of the flange web 3 and are embodied, above the support points of the running wheels 2 on the flange parts, so as to project toward the web 3, whereby their rotational axis is oriented perpendicular relative to the direction of travel. As FIG. 1 shows in schematic fashion, one of the running wheels 2 is directly driven by motor. This running wheel 2 can thus roll in the carrier deeply and near the web, so that no toothed wheel flange is required. The lower bar ends 4*a* are connected to each other below the travelling rail 1*a* via a horizontal connecting traverse 5, whose lateral surfaces are equipped with a slot 6 at a right angle to its longitudinal direction. Into this slot 6 engages a complementary projection 7 arranged on the associated lower bar end 4*a*. The slot 6 and the projection 7 are oriented in the direction of travel and have rectangular cross-sections. In addition, the bar ends 4*a* are attached to the connecting traverse 5 on both sides by means of screws. (However, instead of using screws 8 with associated internal threads in the connecting traverse 5, it is also possible to use screws 8 and clamping sleeves.) In FIG. 1, the lateral surfaces of the connecting traverse 5 are located in an area vertically below the support of the running wheels 2.

Laterally, on both sides of the web, two guide rollers 9, which are located opposite to each other and whose rotational axis 10 (see FIG. 2) runs perpendicular relative to that of the running wheels 2, rest in front of and behind each running wheel 2 on the lateral surfaces of the lower flange 1.

The guide rollers 9 are also rotatably-mounted in the associated bar 4. The two bars 4 form a C open at the top, which, on its inner sides, at the level at which the guide rollers 9 contact the flange parts, has a vertical surface 19 oriented parallel to the running direction. The distance between the two surfaces 19 is equal to the greatest width of the lower flange 1. A horizontal surface 20, which is located above the support points of the running wheels 2, is arranged above the surface 19.

Figure 2:
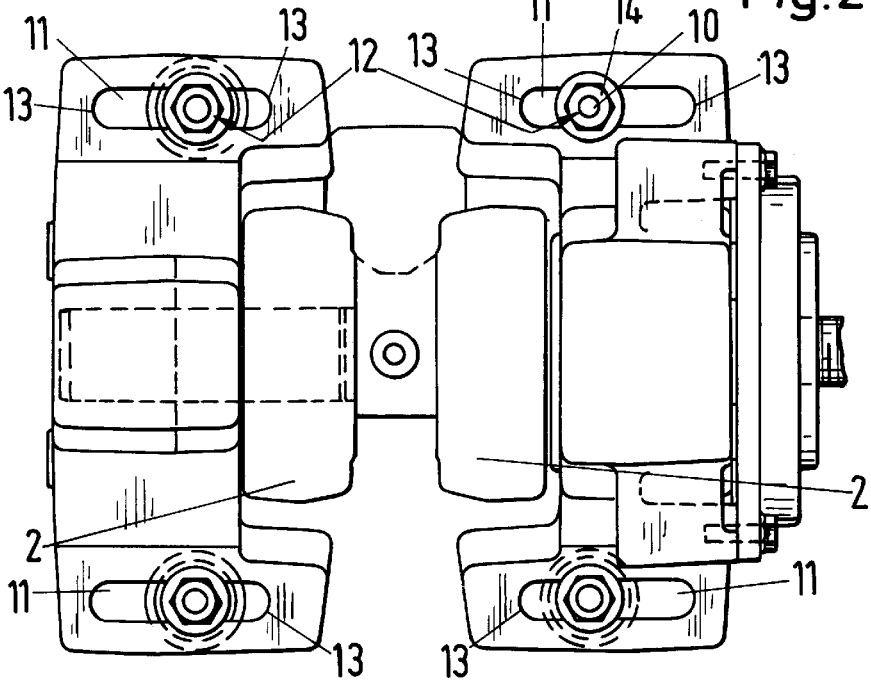
FIG. 2 is a top view of the travelling mechanism in FIG. 1.

As FIG. 2 shows in a top view of the travelling mechanism, the guide rollers 9 are located opposite to each other in pairs. The distance of the guide rollers 9 to each other is adjustable, so that the guide rollers 9 can be adjusted to the given flange width. The vertical rotational axes 10 of the guide rollers 9 are inserted through longitudinal slots 11 embodied on the bars 4. In FIG. 2, the four longitudinal slots 11 are located on a common horizontal plane and run parallel to the rotational axis 10 of the running wheels 2. The rotational axes 10 are embodied as bolts 12, which, flattened in the upper area on two sides 10*a*, are run in slots 11*a*. The two flattened sides 10*a* lie parallel to each other as well as parallel to the longitudinal direction of the bolts 12. The desired rotational axis position is adjustable inside the two end positions 13 defined via the longitudinal slot 11, specifically, by tightening the fixing nut 14. To determine the given rotational axis position, a measuring strip (not shown) can be arranged, on each longitudinal slot 11 between the end positions 13, on a side of each bar 4.

Figure 3:
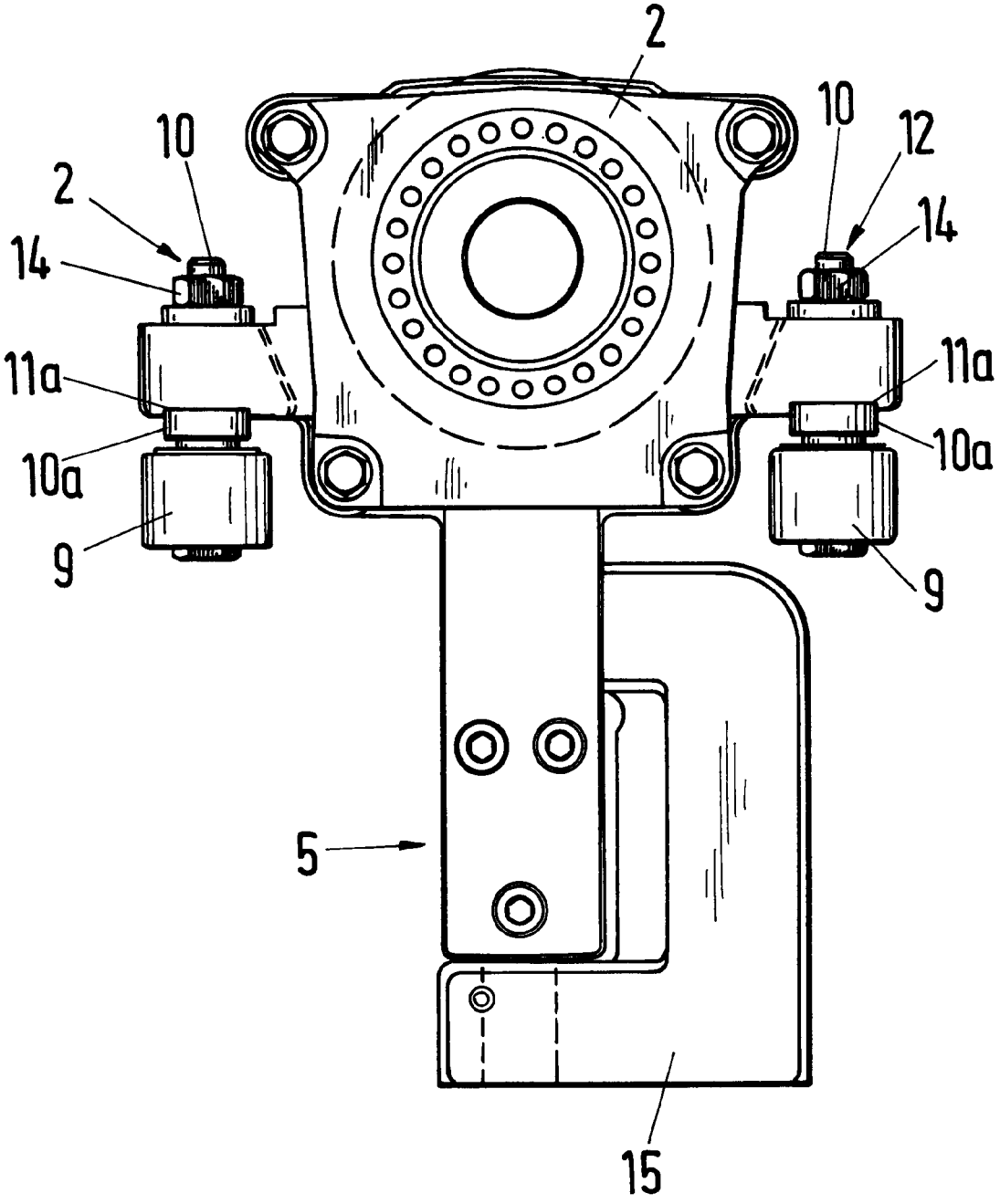
FIG. 3 is a side view of the travelling mechanism in FIG. 1.

FIGS. 1 and 3 show a load suspension means 15, which is supported in articulated fashion on the upper side of the connecting traverse 5. The C-shaped load suspension means 15 has a spherical head 16, which is mounted in articulated fashion in a complementary ball socket 17 (see FIG. 1). The lower end of the load suspension means 15 is equipped on its inner side with a rotary-mounted sliding piece 17*a* that engages into a guide slot 18 embodied on the lower side of the connecting traverse 5 and oriented at a right angle to the direction of travel.

Alternatively, however, it is possible for the connecting traverse 5 and one of the bars 4 to be embodied in a single piece. In this case, during assembly, only one bar 4 must be attached to the L-shaped bar/connecting traverse part.

The invention is not limited by the embodiments described above which are presented as examples only but can be modified in various ways within the scope of protection defined by the appended patent claims.

I claim:

1. A travelling mechanism for a rail having flange parts and a web, comprising:

lateral bars;

means for connecting together the lateral bars below the rail so that the lateral bars are spaced from each other, the connecting means including a connecting traverse, the spacing of the lateral bars being adjustable;

running wheels rotatably mounted to the lateral bars so as to be opposite each other, the running wheels being restable on the flange parts of the rail;

guide rollers rotatably mounted to the lateral bars, in front of and behind each running wheel, the guide rollers being parallel to the web and engageable with lateral edges of the flange parts, each of the guide rollers being rotatable about a respective vertical rotational axis; and means for varying a distance between the vertical rotational axes of the guide rollers independent of the running wheels so that the guide rollers can be adjusted to a desired flange width of the rail, the distance varying means including a longitudinal slot provided in each of the lateral bars above each of the guide rollers, each longitudinal slot being arranged on a horizontal plane so as to extend at a right angle to a direction of travel of the travelling mechanism, the vertical rotational axis of an associated one of the guide rollers extending through the longitudinal slot, each position of the rotational axis being fixable within two end positions defined by the longitudinal slot.

2. A travelling mechanism as defined in claim 1, wherein each rotational axis is embodied as a bolt flattened on both sides so as to have a larger diameter that is larger than a width of the longitudinal slot.

3. A travelling mechanism as defined in claim 1, wherein the connecting traverse has lateral surfaces formed with a slot at a right angle to a longitudinal direction of the connecting traverse, an associated lower end of each bar having a complementary projection that engages in the slot in a positive-locking manner.

4. A travelling mechanism as in claim 3, wherein the slot is oriented in a direction of travel of the travelling mechanism.

5. A travelling mechanism as defined in claim 3, wherein the slot has a rectangular cross-section.

6. A travelling mechanism as defined in claim 3, wherein the lateral surfaces of the connecting traverse are arranged in an area vertically below the running wheels.

7. A travelling mechanism as defined in claim 1, wherein the connecting traverse and one of the bars form a single piece.

8. A travelling mechanism as defined in claim 1, wherein the connecting means further includes screws and clamping sleeves provided at the ends of the bars so as to attach the bars to the connecting traverse.

9. A travelling mechanism as defined in claim 1, and further comprising suspension means supported on the connecting traverse for supporting a load.

10. A travelling mechanism as defined in claim 9, and further comprising ball and socket means embodied on an upper side of the connecting traverse for supporting the load suspension means in an articulated fashion.

11. A travelling mechanism as defined in claim 9, wherein the load suspension means includes a C-shaped member having a lower end equipped with a rotatably mounted sliding piece that engages into a guide slot arranged on a lower side of the connecting traverse at a right angle to the direction of travel.

12. A travelling mechanism as defined in claim 1, wherein the bars are configured to have a portion above support points of the running wheels on the flange parts that projects toward the web.

13. A travelling mechanism as defined in claim 1, wherein the two bars form a C shape open at its top, which C has inner sides with opposing vertical surfaces oriented parallel to the running direction at a level at which the guide rollers contact the flange parts.

14. A travelling mechanism as defined in claim 13, wherein the vertical surfaces are separated by a distance equal to a largest flange width of a lower of the flange parts.

* * * * *